US006101642A

United States Patent [19]

Auten et al.

[11] Patent Number: 6,101,642

[45] Date of Patent: Aug. 15, 2000

[54] FOLDABLE WATERTIGHT BATHTUB INSERT

[76] Inventors: Constance L. Auten; Charla R. Couch, both of 36922 Stevens Blvd., Willoughby, Ohio 44094

[21] Appl. No.: 09/329,448

[22] Filed: Jun. 10, 1999

[51] Int. Cl.[7] ..... A47K 3/02

[52] U.S. Cl. ..... 4/580; 4/582; 4/546; 4/599; 4/600

[58] Field of Search ..... 4/580, 546, 559, 4/599, 600, 612, 552, 581, 582, 583

[56] References Cited

U.S. PATENT DOCUMENTS

| | | | |
|---|---|---|---|
| 3,045,254 | 7/1962 | Cook et al. | 4/580 |
| 4,989,279 | 2/1991 | Powell | 4/599 |
| 5,205,001 | 4/1993 | O'Connell | 4/599 |
| 5,544,369 | 8/1996 | Roberts | 4/599 |

*Primary Examiner*—David J. Walczak
*Attorney, Agent, or Firm*—Joseph H. Taddeo

[57] ABSTRACT

An improved watertight bathtub insert having foldable members that are laminated and joined to form a safe portable and easily stored bathtub insert that can be chemically treated on the surface with an antibacterial formulation for the preservation of health. The enclosure is comprised of four upright sidewalls and a bottom platform, forming a watertight, rectangular cubicular space; having a watertight, doubly gasketed, entrance door and a drawbridge styled ramp. Each of the sidewalls is made preferably of a preformed and shaped fiberglass core, laminated between thin sheets of silicone rubber, and electronically bonded and sealed to form a unitized watertight enclosure that can be folded into a portable compact unit that is easily stored. The base platform is made preferably of rubber and has a cushioned bottom surface, that has frictional resistance and stability when the unit is inserted into a bathtub or shower stall. The rubber base also provides frictional resistance on the top surface to ensure a good frictional contact between the occupant and top surface to prevent accidental slipping. A removable hydraulic control panel extends the supply of water to the interior of the enclosure, for the convenience of the occupant. The totally integrated unit displays added safety devices, such as an adjustable, multilevel, cushioned seat, pull-down grab-bars, easy-open doors and a thermally barricaded water control panel.

17 Claims, 6 Drawing Sheets

FOLDABLE WATERTIGHT BATHTUB INSERT

FIELD OF THE INVENTION

The present invention relates primarily to an improved watertight bathtub liner, and more particularly, to a foldable bathtub insert having foldable members that are laminated and joined to form a safe portable and easily stored bathtub insert that can be chemically treated on the surface with an antibacterial formulation for the preservation of health.

BACKGROUND OF THE INVENTION

There have been numerous bathtub liners previously disclosed in the art. In general, several relate to the need for a disposable bathtub liner that provides for low maintenance cleanliness, while others provide cushioning for the added comfort to the occupant. Still others in the art serve to prevent accidents due to slipping in the bathtub.

To prevent injury from slipping and falling in a bathtub, bathtub liners were used. Some of the protective measures that were used were the use of tub mats placed on the bottom of a bathtub that were held in place by using suction cups, and the like. To further prevent more serious injury from slipping and falling, cushioned side panels were used to cushion the impact in the event of such a fall.

Examples of these types of liners are as follows:

U.S. Pat. No. 3,931,651, granted Jan. 13, 1976, to F. X. Weir, discloses a thin flexible liner, having a horizontal flange overlying the top surface of a bathtub, where the liner is open at the bottom, leaving the bottom of the bathtub exposed. The main portion covers the sidewalls of the bathtub. Magnetic or suctioning means holds the liner in contact with the top surface.

U.S. Pat. No. 4,602,393, granted Jul. 29, 1986, D. E. Fiveash, discloses a bathtub liner made in an integral sheet of plastic material, shaped to conform to the bottom, sides, vertical at one end and sloping at the opposite end. The liner includes a drain opening in its floor positioned over the bathtub drain so that water can be drained from the liner.

U.S. Pat. No. 4,956,882, granted Sep. 18, 1990, to H. S. Cohn, III, teaches of a bathtub liner comprising a bottom panel, two lateral panels and an end panel, the panels having a non-slip surface. The rigid lateral panels are secured to the tub walls by suction cups. Detachable support members (handles) are affixed to the side panels.

U.S. Pat. No. 5,144,703, granted Sep. 8, 1992, to L. M. Maire, discloses a bathtub liner for insertion into a bathtub, having parallel sidewalls, a floor coextensive with the sidewalls, and a rear wall having a cushioned headrest at the upper termination. The sidewalls are pneumatically or fluidally filled. Strategically placed suction cups secure the liner to the bathtub.

U.S. Pat. No. 5,153,950, granted Oct. 13, 1992, to J. M. Sowers, teaches of a disposable flexible bathtub liner having a roughened top surface to provide frictional engagement between the individual and the liner surface. Clamp members secure the liner to the bathtub. A drain assembly provides for the egress of water after use.

U.S. Pat. No. 5,216,764, granted Jun. 8, 1993, to H. Hall, et al., discloses a bathtub and shower liner comprised of a thin, flimsy, disposable, sterile, contoured, impervious, plastic film sheer linings, with a non-slip, cushioned mat-like bottom sheet. Each disposable film sheer is watertight and nontoxic as a means to protect against transmission of infection or disease.

The prior art recited above does not teach of the novel advantages that are found in the present invention.

Presently, there is a particular need for a safe portable watertight bathtub insert that can be compactly folded for storage when not in use; one that can provide safe usage to those who are physically disadvantaged, either temporary or permanently, through injury or disease.

Accordingly, it is therefore an object of the present invention to provide a watertight bathtub insert that provides for the safety of the individual occupying the bathtub.

It is another object of the present invention to provide a watertight bathtub insert that is foldable in a compact unit for ease of transporting and for compact storage.

It is still another object of the present invention to provide a watertight bathtub insert having a watertight design comprised of a bottom with four sidewalls.

It is still yet another object of the present invention to provide a watertight bathtub insert having a doubly gasketed door.

It is still a further object of the present invention to provide a watertight bathtub insert having a removable hydraulic control and extension panel housing the shower head, mixing control valve and bathtub spout.

It is still yet a further object of the present invention to provide a watertight bathtub insert having a convenient arrangement for the accoutrements contained in the insert.

An additional object of the present invention is to provide a watertight bathtub insert having an adjustable cushioned seating platform.

Another added object of the present invention is to provide a watertight bathtub insert having dual drains for either left-handed or right handed access.

Still another added object of the present invention is to provide a watertight bathtub insert having extension arms to operate the drain mechanisms.

A final object of the present invention is to provide a watertight bathtub insert having dual longitudinal safety handles.

These as well as other objects and advantages of the present invention will be better understood and appreciated upon reading the following detailed description of the preferred embodiment when taken in conjunction with the accompanying drawings.

SUMMARY OF THE INVENTION

The present invention relates primarily to a novel watertight bathtub insert. It has a rubber base or platform that provides a cushioned bottom surface, having a frictional resistance and stability when the unit is inserted into a bathtub or shower stall. The rubber base also provides frictional resistance on the top surface to ensure a good frictional contact between the occupant and top surface, thereby preventing injury to the occupant because of slipping.

The bathtub insert can be used in either a shower stall or tub, where it can function as either a tub or a shower. The present invention provides for two sizes—one being rectangular in shape for use in a tub; the other being more square in shape for use in a shower stall.

The height of the insert ranges between 4 to 6 feet to allow for higher water level. This height allows for more privacy for the occupant. It is manufactured using molded fiberglass forms, laminated between two thin layers of rubber like materials, such as a silicone rubber formulation.

Once a person enters the tub, each needed item, used for bathing purposes, is conveniently stored for them and is available within an arm's length reach. On the surface of one of the side panels, holders are provided to allow for the convenient storage of soaps, shampoo, and the like. It has a custom-made feature in that the inside wall allows for a cutout opening to be made for the soap dish that was previously installed in the purchasers home. This cutout may not be necessary in all installations.

The holder or clamp for the shower head is provided to be attached over the outside lip of the bathtub insert. This holder also contains easily installed remote water faucets that are fully operational from inside the tub.

A watertight door is sealed by means of two gaskets, that is similar to those used in a submarine hatch. The entire assembly contains drainage openings for the overflow of water overflow, should it rise abnormally in level.

For safety, it has exterior and interior safety handles for fastening the seal; the handles having grips that are similar to those used on an amusement park ride that pull up and down like a switch. A safety bar, extending around three quarters of the tub at the top, serves as a handle, which can be gripped as needed to support and steady one's self. This bar at the top also serves as a towel-rack when not being used as a safety grip.

The bathtub insert has a removable built-in seat that slides in at several levels for maximum comfort and personal fit. The seat is designed to support a maximum of 500 pounds of weight. Three convenient levels for the seat are provided: the lowest position is 15 inches; the middle position is 24 inches; and the highest position is 30 inches.

These objects, in addition with other objects of the present invention, along with various features of novelty that characterize the invention are detailed in the appended claims, forming a part of this disclosure. For a better understanding of the invention, reference should be made to the accompanying drawings and descriptive matter that details the preferred embodiment of the present invention.

BRIEF DESCRIPTION OF THE DRAWINGS

The present invention is pictorially illustrated in the accompanying drawings that are attached herein.

DETAILED DESCRIPTION OF THE INVENTION

Figure 1:
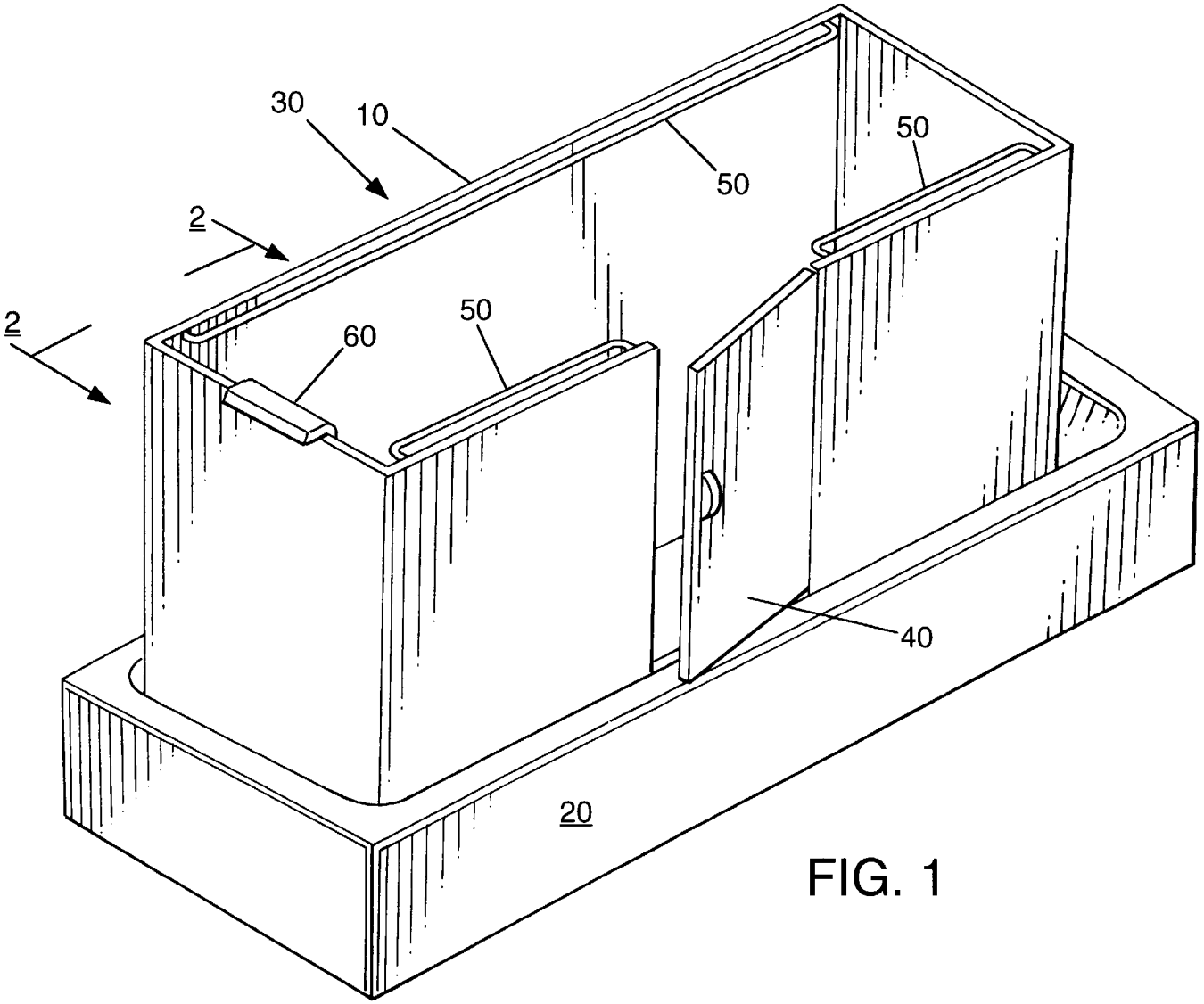
FIG. 1 is an axonometric projection of the preferred embodiment illustrating the watertight bathtub insert positioned in a conventional bathtub.

With reference now to the drawings, and in particular FIGS. 1 through 11, there is shown a new and improved bathtub insert that can be used by those who may be physically injured or disadvantaged. This novel bathtub insert apparatus embodies the principles and concepts of the present invention and is generally designated by the reference numeral 10. The insert 10 may be bowl shaped or cylindrical, but it is preferably rectangular.

FIG. 1 illustrates the typical utilization 30 of the watertight bathtub insert 10 when installed in a typical bathtub 20. The insert 10, comprised of four walls, that is two sidewalls and two endwalls, and a bottom platform, provides for a watertight bathing enclosure. The bottom platform has a rubber base that provides a cushioned bottom surface, to stabilize the unit when installed into a bathtub or shower stall. Additionally, this rubber base also provides frictional resistance on the top surface to ensure a good frictional contact between the occupant and the top surface to prevent injury to the occupant because of slipping.

Longitudinal safety bars 50, positioned along the top of the insert 10, also can serve as towel racks when not being used to stabilize the occupant. The person desiring to use the bathing facility insert enters the insert 10 using the gasketed door 40. This watertight door is sealed by means of two gaskets, running around the inner perimeter of the door. An exterior handle provides the convenience upon entering the watertight enclosure. Additionally the handle contains a quick-release, closure mechanism (not shown) that is easily opened from the inside by exerting a minimal force on the release actuator.

Hooked over the top of the bathtub insert is the removable hydraulic control panel assembly 60. This panel provides an extension of the water supply lines to the inside of the enclosure so that the flow of water can be directed to the bathtub filling spout or to the shower head. The control panel assembly 60 can be hooked to either end of the bathtub insert, dependent upon the placement direction of the insert into the bathtub. If the bathtub were positioned so that it is rotated 180 degrees from that shown in FIG. 1, the hydraulic panel would be placed at the opposite end shown.

Figure 2:
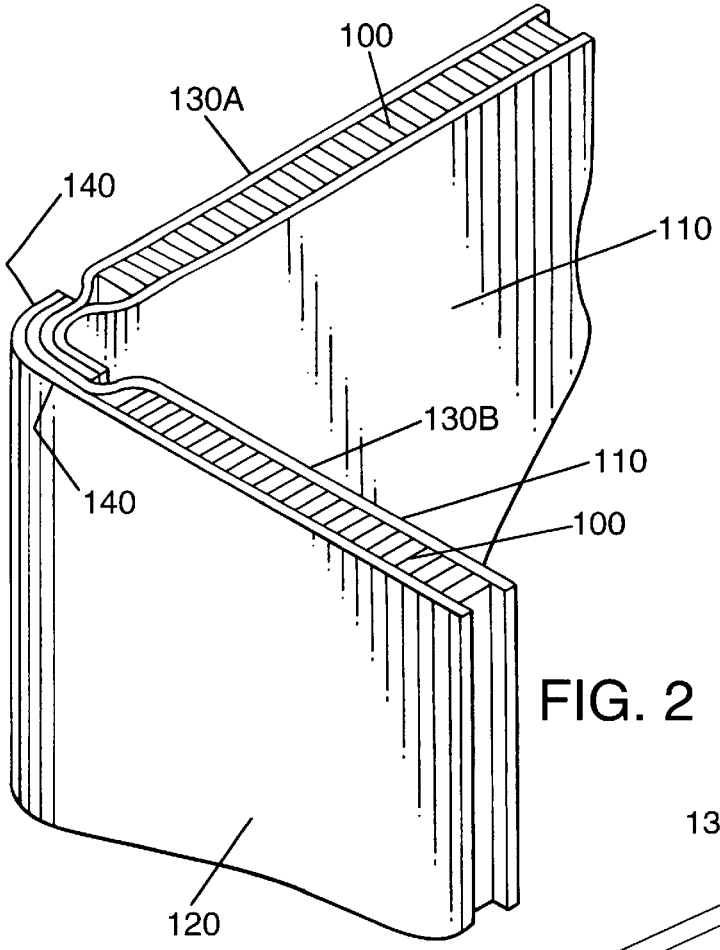
FIG. 2 is a fragmentary axonometric sectional projection 2—2, as shown in FIG. 1, of the watertight bathtub insert, showing the laminated assembly.

FIG. 2 shows the detailed construction of the laminated panels, taken along the fragmentary section 2—2, as shown in FIG. 1. The interior composition core of the walls is made preferably from a shaped fiberglass panel 100. Each wall, sidewall and endwall, is from a core of a shaped fiberglass panel 100, that is sandwiched between an inside thin silicone rubber sheet 110 and an exterior thin silicone rubber sheet 120. These laminated panels of walls 130A and 130B are joined preferably by either a contact cement or by electronic bonding to form the watertight enclosure. A typical corner of the enclosure is bonded by overlapping along the laminated edges, as depicted by the numeral 140.

Figure 3:
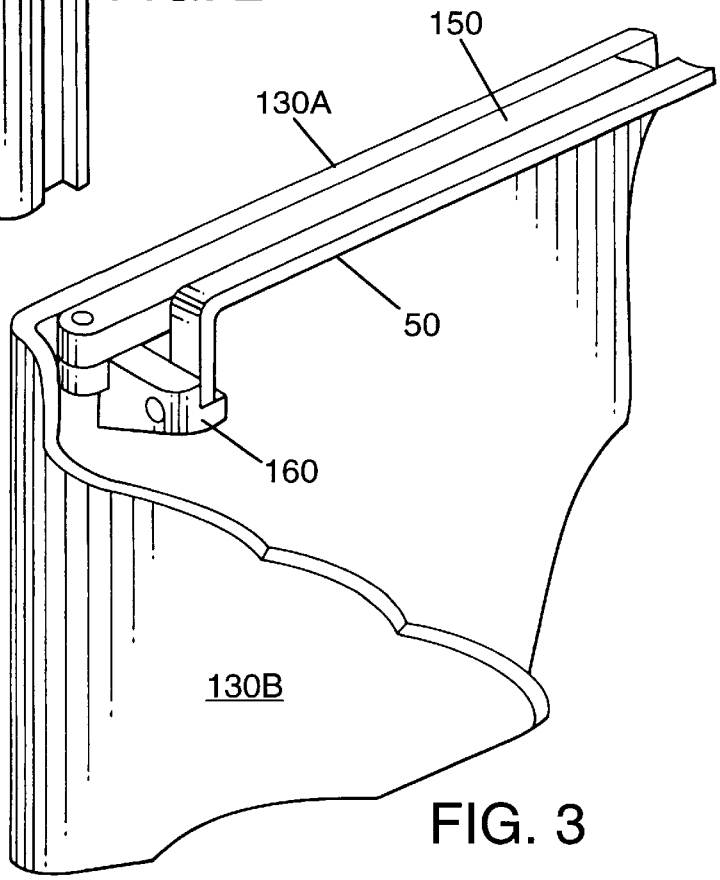
FIG. 3 is a fragmentary axonometric sectional projection of the watertight bathtub insert showing a longitudinal safety bar and sidewall stiffener support member in their nested position.

Turning now to FIG. 3, there is shown one of the longitudinal safety bars 50 and one of the sidewall stiffener support members 150 in their nested positions. A single support bracket 160 is shown supporting the longitudinal safety bar 50 and the sidewall stiffening member 150. A similar support bracket (not shown) at the opposite end of the safety bar supports the safety bar only.

Figure 4:
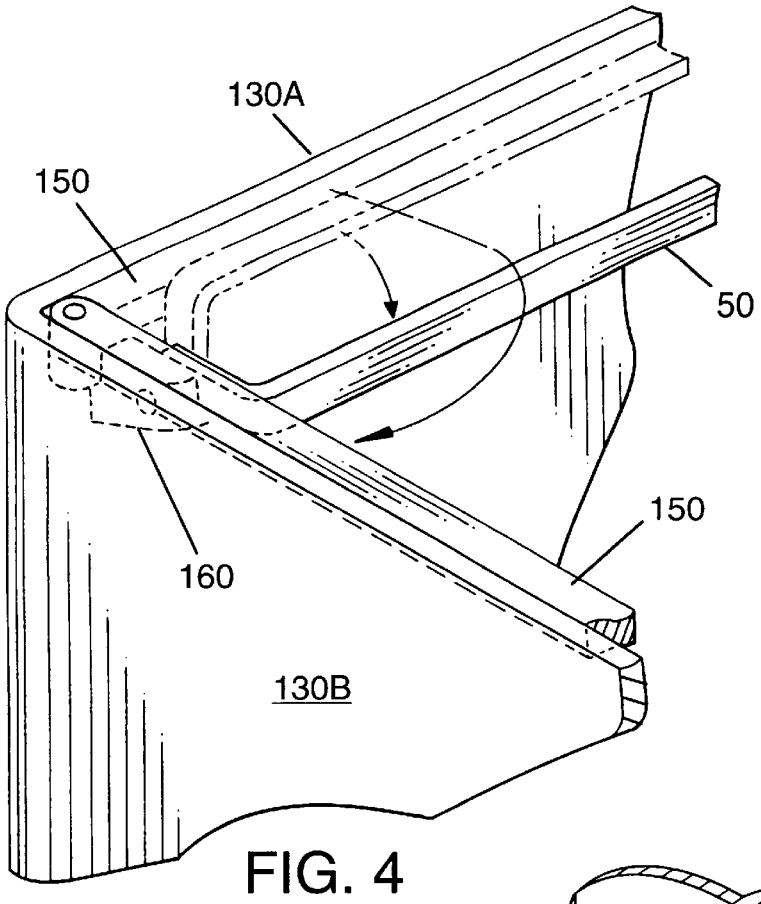
FIG. 4 is a fragmentary axonometric sectional projection of the watertight bathtub insert showing a longitudinal safety bar and sidewall stiffener support member in their open extended position.

As shown in FIG. 4, there is one of the longitudinal safety bars 50 and one of the sidewall stiffener support members 150 shown in their opened installed positions. Because the bathtub insert is of a novel foldable and collapsible design, the sidewall stiffener support members 150, when engaged, co-act with the sidewalls to maintain a stable erect watertight enclosure.

Figures 5, 7:
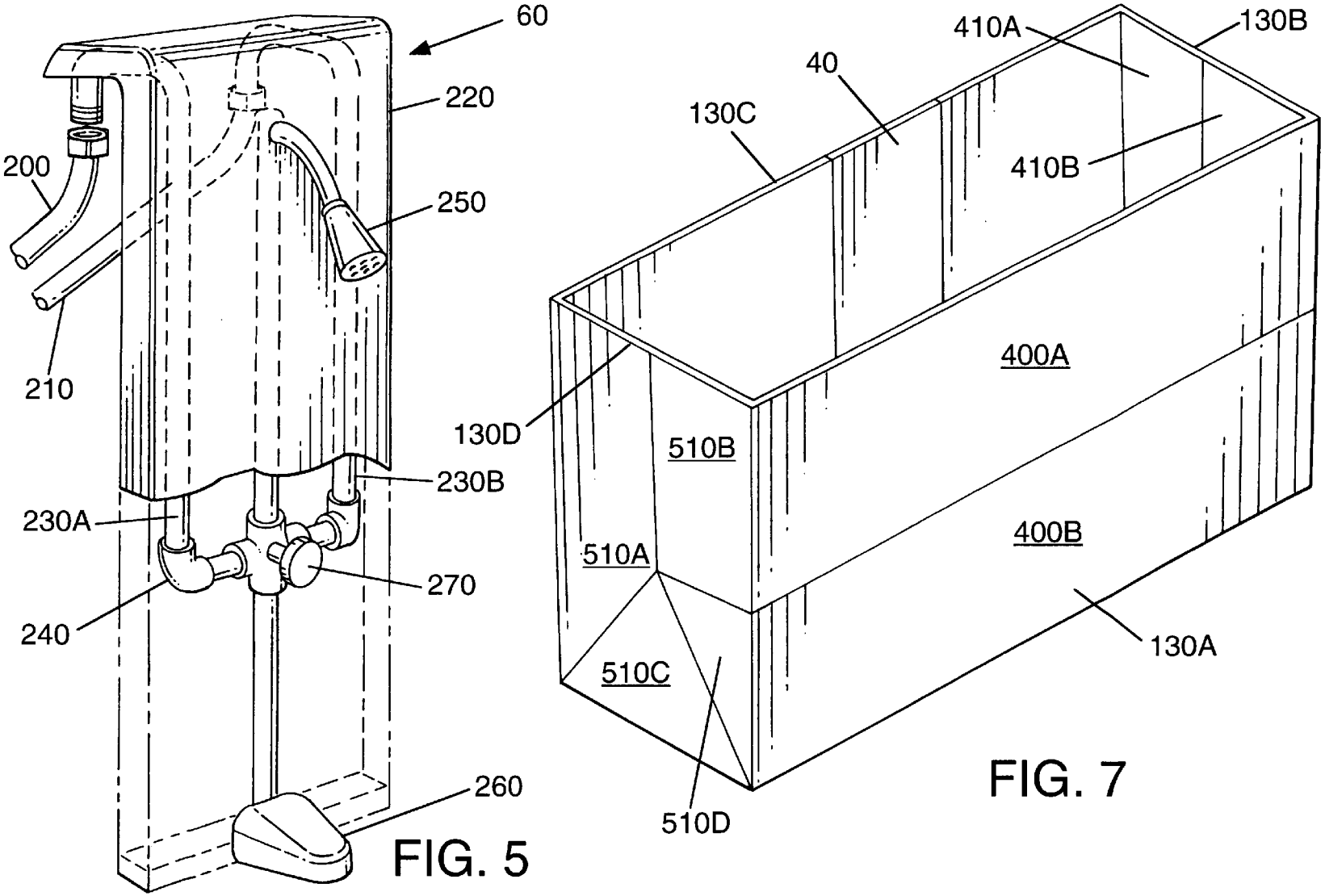
FIG. 5 is a fragmentary perspective view of the hydraulic control-panel input system of the watertight bathtub insert.
FIG. 7 is an axonometric view of the versatile foldable watertight bathtub insert in its unfolded position and detailing the foldable segments.

The removable hydraulic control and distribution panel assembly 60 is shown in FIG. 5. Because of the universal design of the bathtub insert, the hydraulic control panel 60 may be placed at either end of the insert; generally nearest the water supply connection. The hot water inlet hose 200, and the cold water inlet hose 210 provide the water connections for the remote operation of the shower head 250 and the bathtub filling spout 260. The hot and cold water tubing, 230A and 230B, conduct the flow of water from their respective hose connections to the mixing valve 240. The plastic, thermally inaulated protective housing 220 protects the occupant from coming in contact with the tubing. Blending the flow of water to provide for the preferred temperature and flow rate is controlled by adjusting the mixing valve 240 via rotation of control knob 270.

Figure 6:
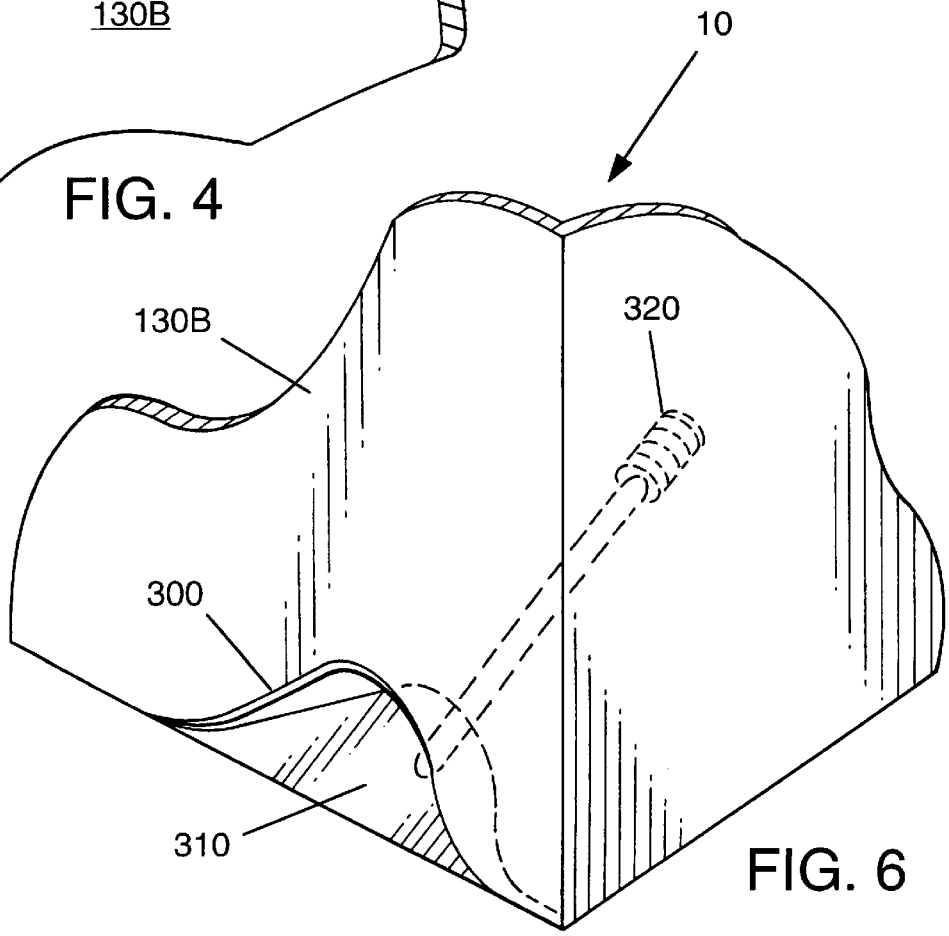
FIG. 6 is a fragmentary perspective view, detailing one of the two available manually operated drain openings of the watertight bathtub insert.

Illustrated in FIG. 6 is one of two drain openings 300 located at the bottom of the watertight bathtub enclosure 10. The second drain opening (not shown) is located in the endwall parallel to and directly across from the endwall 130B. When filling the tub, the drain stopper flap 310 is closed by operating the drain actuating handle 320.

Two drain openings are provided at each end of the bathtub insert because the placement of the insert is dependent upon the placement of the bathtub. If the bathtub were positioned so that it was rotated 180 degrees from that shown in FIG. 1, a second drain opening is needed to drain the water from the bathtub insert into the bathtub drain.

Figure 8:
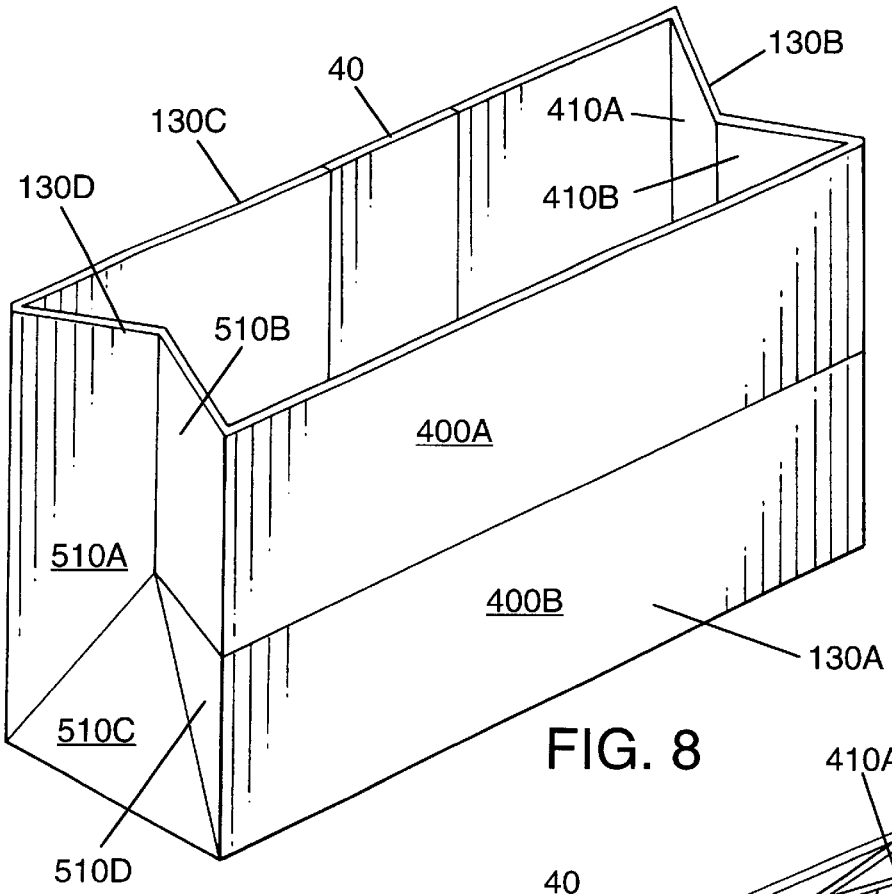
FIG. 8 is an axonometric view of the versatile foldable watertight bathtub insert in its partially unfolded position.
Figure 9:
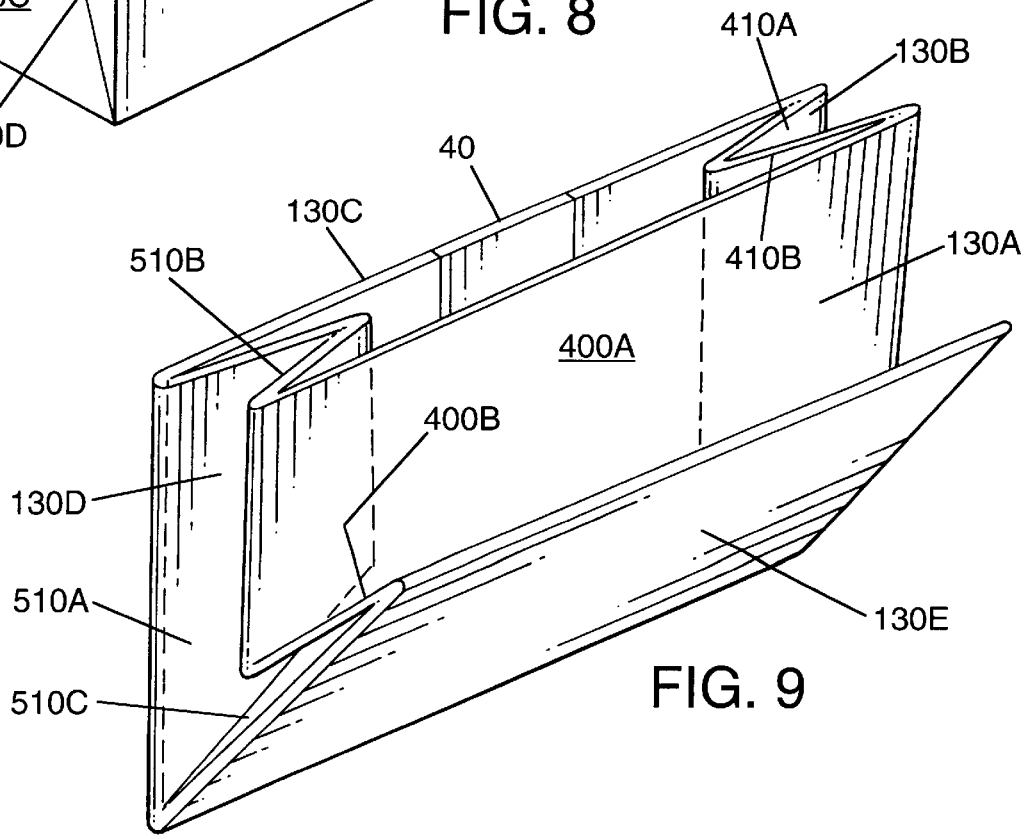
FIG. 9 is an axonometric view of the versatile foldable watertight bathtub insert in its near folded position.

Turning now to FIGS. 7, 8, and 9, there is shown in sequence, the folding aspect of the watertight bathtub insert into a compact, portable unit.

This foldable watertight bathtub insert is comprised of several shaped laminated panels.

Figure 10:
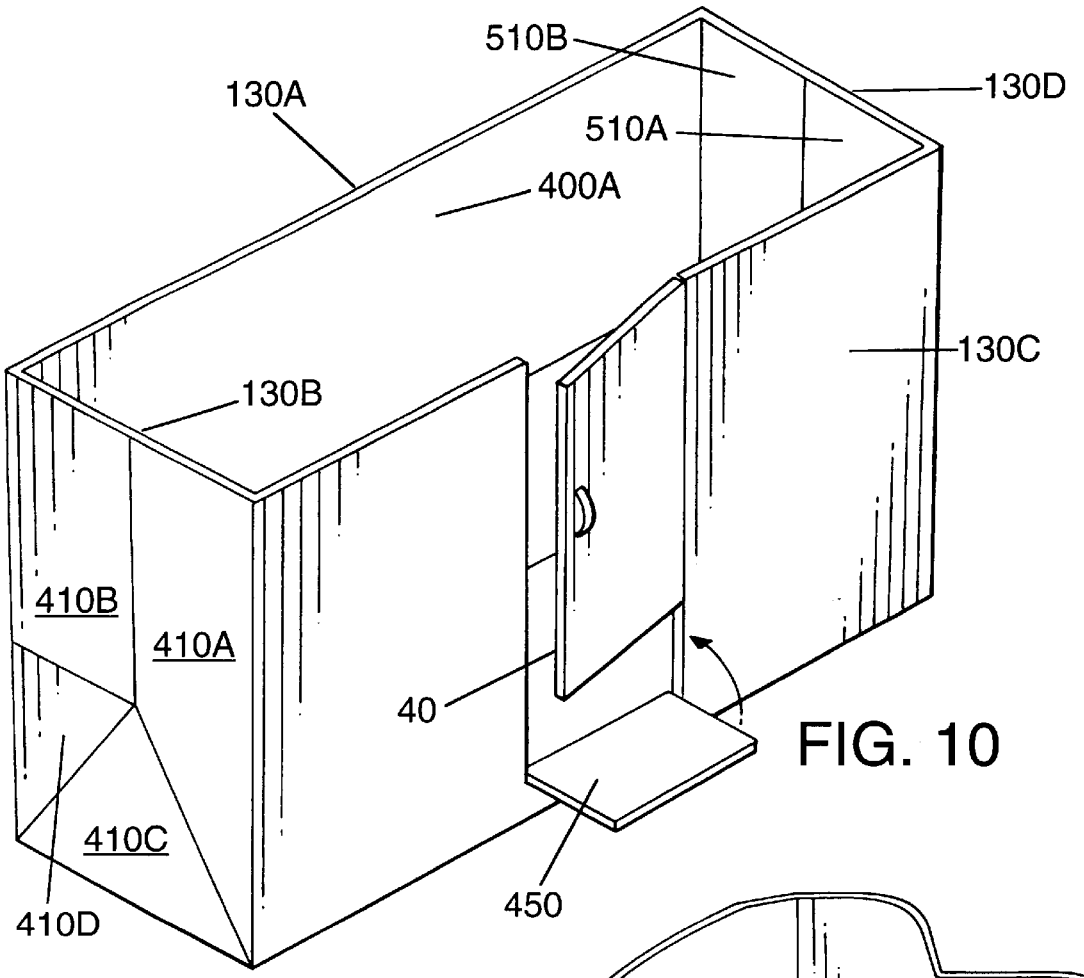
FIG. 10 is an axonometric projection of the versatile foldable watertight bathtub insert in its unfolded position showing the entrance door and ramp when used as a stand-alone bathtub or shower stall.

The laminated longitudinal sidewall 130A, (the side opposite and parallel to the sidewall 130C), having a door and door opening 40, and a ramp 450 (as shown in FIG. 10)), is comprised of 2 rectangular panels, 400A and 400B.

The laminated longitudinal end sidewall 130B, is comprised of 4 joined shaped panels, 410A, 410B, 410C and 410D, where 410A is irregular in shape and 410B is a smaller rectangular shaped panel. Lower panel 410C is as an equilateral triangle and lower panel 410D is shaped as a right triangle.

The laminated longitudinal sidewall 130C contains a door and door opening 40, and a ramp 400 (as shown in FIG. 10), and contains no folding creases.

The laminated longitudinal end sidewall 130D contains the same shaped panels as its parallel counterpart, 130B. It is comprised of 4 joined shaped panels, 510A, 510B, 510C and 510D, where 510A is irregular in shape and 510B is a smaller rectangular shaped panel. Lower panel 510C is as an equilateral triangle and lower panel 510D is shaped as a right triangle.

The laminated bottom platform 130E contains no folding creases. This laminated rubber base has a cushioned bottom surface, which furnishes frictional resistance to stabilize the unit when it is inserted into a bathtub or shower stall. To further prevent injury to the occupant, perhaps caused by accidental slipping, the top surface of the rubber base is coated with a contact material to provide a good frictional contact between the occupant and top surface.

In another aspect of the present invention, the portable, foldable, watertight enclosure can also be used in several other areas of application, as illustrated in FIG. 10. These areas of application include a portable shower stall and bathtub apparatus for use in camp grounds and camping trips, in emergency shelter areas that may have suffered damage due to storms or floods, or even in military field applications for use by transient displaced persons.

In these applications, the area located beneath the door 40 is folded downward to create an entrance ramp 450 for the convenience for the person entering the portable bathing enclosure. This ramp 450 is gasketed in a like manner, such as used on the door 40.

Figure 11:
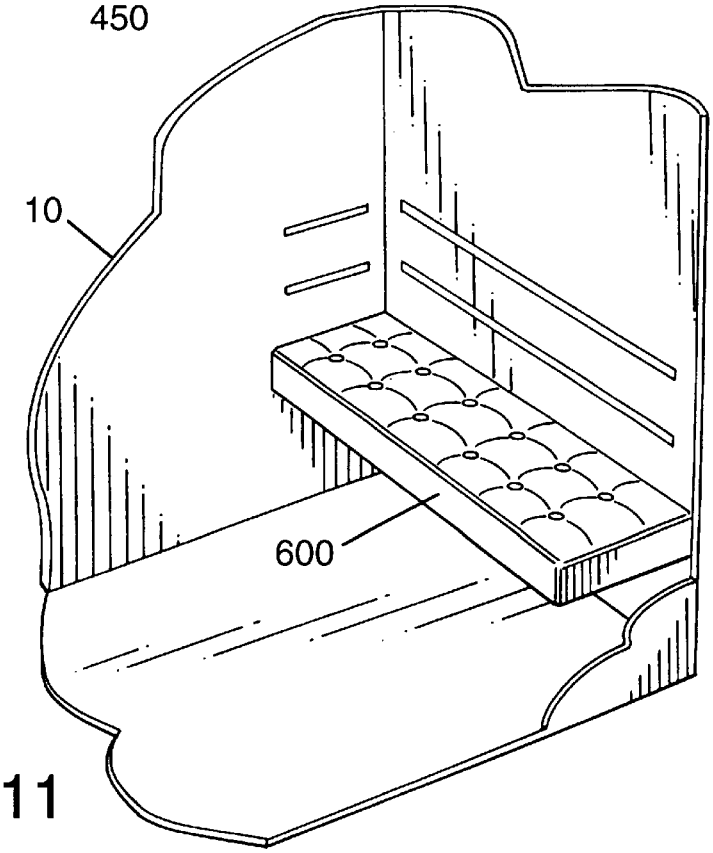
FIG. 11 is a fragmentary axonometric sectional view of the adjustable cushioned seating arrangement within the watertight bathtub insert.

With reference to the drawing shown in FIG. 11, a fragmentary view of the cushioned seating arrangement is illustrated. The foldable bathtub insert 10 has a removable built-in, multilevel, cushioned seat 600 that slides in at a plurality of heights for maximum comfort and personal fit. This seat is designed to support a maximum of 500 pounds of weight. In the preferred embodiment, three convenient seating levels are provided: the lowest position is 15 inches; the middle position is 24 inches; and the highest position is 30 inches.

Whereas the present invention has been described in detail in accordance with the drawing attached herein, it should be understood by those skilled in the art, that further modifications and improvements can be made without detracting from the spirit and scope of the present invention. The illustrations given above are by way of example only, and the true scope and definition to be as set forth in the following claims.

What is claimed is:

1. A bathtub liner for installation in a bathtub or shower stall, comprising:

an insert with a wall assembly and a bottom platform comprising a watertight bathing enclosure;

the wall assembly comprising four upright interconnected walls each of the walls comprising laminated panels;

means for interconnecting the walls, said walls including two essentially parallel sidewalls and two essentially parallel endwalls; and, further comprising an opening with watertight gasketed door in at least one of said sidewalls for entering and exiting the watertight enclosure.

2. The bathtub liner according to claim 1, further comprising a removable hydraulic control panel assembly associated with an at least one of said sidewalls, whereby a water flow can be directed into the insert.

3. The bathtub liner according to claim 2, wherein the hydraulic control panel assembly depends from one of the sidewalls.

4. The bathtub liner according to claim 3, the laminated panels of each wall comprising a fiberglass core laminated between an interior silicone sheet and an exterior silicone sheet.

5. The bathtub liner according to claim 4, each of the sidewalls and endwalls having an essentially rectangular shape; and, wherein the endwall members each include four panels joined at creased fold lines, the sidewall opposed to that having the door including two panels joined at a single crease line, said liner comprising a foldable, completely collapsible portable unit.

6. The bathtub liner according to claim 5, each sidewall having a reinforcing bar with an opened installed position in engagement with an opposed sidewall, for co-action with the sidewalls to maintain a stable and upright watertight enclosure.

7. The bathtub liner according to claim 6, each sidewall further comprising a sidewall bracket and a repositioning longitudinal safety bar retained on the bracket.

8. The bathtub liner according to claim 7, wherein the reinforcing bar is also retained on the bracket.

9. The bathtub liner according to claim 8, the safety bar having a nested position adjacent its respective reinforcing bar and sidewall and an extended position for use as a towel rack.

10. The bathtub liner according to claim 9, the hydraulic control panel assembly comprising hot and cold water inlets and tubing communicating with a shower head and bathtub filling spout through a mixing valve having a rotatable control knob, for blending the flow of hot and cold water to a preferred temperature and flow rate.

11. The bathtub liner according to claim 10, the hydraulic control panel assembly further comprising a thermally insulated housing positioned over said tubing, for stabilizing the shower head and spout and for protection from the tubing.

12. The bathtub liner according to claim 11, further comprising an at least one insert drain opening having an associated drain stopper flap and a drain operation handle, positioned near an endwall and in fluid communication with a tub drain.

13. The bathtub liner of claim 12, the longitudinal sidewall with the door further comprising a ramp adjacent the opening and under the door, for the convenience for the person entering the enclosure.

14. The bathtub liner of claim 13, the sidewall opposite the door comprising two rectangular panels separated by a crease; and, wherein each rectangular endwall is comprised of first, second, third and fourth joined shaped panels that together form a rectangle, each panel separated by a crease, the first panel having an irregular shape; the second panel having a rectangular shape; the third panel shaped as an equilateral triangle; and, the fourth panel shaped as a right triangle, whereby the liner can be collapsed and folded to an essentially flat array to facilitate portability and storage;

the laminated sidewall with the at least one door opening and door comprising a single panel with no folding creases.

15. The bathtub liner according to claim 14, further comprising a seating assembly including at least one longitudinal slot grooved in the walls and removable seat fitted into a slot at a comfortable height.

16. The bathtub liner according to claim 15, wherein said means for interconnecting the walls comprising contact cement for joining the silicone sheets of adjacent walls.

17. The bathtub liner according to claim 15, wherein said means for interconnecting the walls comprising an electronic bonding for joining the silicone sheets.

* * * * *